US006007363A

United States Patent [19]

Renk

[11] Patent Number: 6,007,363

[45] Date of Patent: Dec. 28, 1999

[54] MAGNETICALLY LATCHABLE DEVICE FOR ELECTRICALLY COUPLING A POWER SOURCE TO A CIRCUIT

[75] Inventor: Thomas Edward Renk, Indianapolis, Ind.

[73] Assignee: Thomson Consumer Electronics, Inc., Indianapolis, Ind.

[21] Appl. No.: 09/040,986

[22] Filed: Mar. 18, 1998

[51] Int. Cl.[6] ..... H01R 13/64

[52] U.S. Cl. ..... 439/378; 439/39

[58] Field of Search ..... 439/378, 39, 38

[56] References Cited

U.S. PATENT DOCUMENTS

| | | | |
|---|---|---|---|
| 3,521,216 | 7/1970 | Tolegian | 439/216 |
| 3,786,391 | 1/1974 | Mathauser | 439/39 |
| 3,808,577 | 4/1974 | Mathauser | 439/39 |
| 3,810,258 | 5/1974 | Mathauser | 439/39 |
| 4,359,704 | 11/1982 | Coup | 335/285 |
| 4,719,334 | 1/1988 | Rebel | 219/518 |
| 5,382,167 | 1/1995 | Janson | 439/38 |

*Primary Examiner*—Gary F. Paumen

*Attorney, Agent, or Firm*—Jeffrey D. Carter

[57] ABSTRACT

A magnetically latchable device embodied as a battery pack or a platform. The battery pack includes a case, a magnetic component engaging the case to latch the case to a portable device, an alignment member separate from the perimeter of the case to mate with the portable device when the case is magnetically latched to the portable device, an electrical conducting contact disposed within an aperture of the case to be electrically coupled to a circuit housed in the portable device when the case is magnetically latched to the portable device, and a power source disposed within the case and electrically coupled to the electrical conducting contact. The platform includes a case, a magnetic component engaging the case to latch the case to a portable device, an alignment member separate from the perimeter of the case to mate with the portable device when the case is magnetically latched to the portable device, an electrical conducting contact disposed within an aperture of the case to be electrically coupled to a circuit housed in the portable device when the case is magnetically latched to the portable device, and a power jack disposed within an second aperture of the case to electrically couple a power source to the electrical conducting contact.

32 Claims, 8 Drawing Sheets

MAGNETICALLY LATCHABLE DEVICE FOR ELECTRICALLY COUPLING A POWER SOURCE TO A CIRCUIT

BACKGROUND OF THE INVENTION

The present invention generally relates to latchable power sources and more specifically, to a magnetic latching of a first device housing or coupled to a power source to a second device housing a circuit to electrically couple the power source to the circuit.

An electrical circuit within a portable device, e.g., a television, a computer, a calculator, a CD/cassette player, a recorder, a telephone, etc., is sometimes electrical coupled with a rechargeable/replaceable power source housed in or coupled to a device that is latched to the portable device. The magnetic latching of the device to the portable device as known in the art requires a magnet that is sufficiently strong to align and maintain an electric coupling of the power source to the circuit. Such magnets can be expensive and relatively large, especially when the portable device is a miniature device. What is therefore needed is a magnetically latchable device that can properly align and maintain an electrical coupling of a power source to a circuit within a portable device without the use of expensive and relatively large magnets.

SUMMARY OF THE INVENTION

The present invention overcomes the aforementioned drawbacks associated with current magnetically latchable devices. Various aspects of the present invention are novel, non-obvious, and provide various advantages. While the actual nature of the present invention described in detail herein can only be determined with reference to the claims appended hereto, certain features which are characteristic of the present invention disclosed herein can be described briefly.

In accordance with a first aspect of the present invention, a device for electrically coupling a power source to a circuit housed in a portable device comprises a case, and a magnetic component engaging the case to magnetically latch the case to the portable device. The device further includes an alignment member separate from the perimeter of the case that mates with the portable device when the case is magnetically latched to the portable device, and an electrical conducting contact disposed within an aperture of the case and adapted to electrically couple the power source to the circuit when the case is magnetically latched to the case.

In accordance with a second aspect of the present invention, a system for electrically coupling a power source to a circuit comprises a first device including a case, a magnetic component engaging the case, an alignment member separate from the perimeter of the case, and an electrical conducting contact disposed within an aperture of the case and electrically coupled to the circuit. The system further comprises a second device includes a case, a magnetic component engaging the case and magnetically attracted to the magnetic component of the first device, an alignment member separate from the perimeter of the case and mated with the alignment member of the first device, and an electrical conducting contact disposed within an aperture of the case and electrically coupling the power source to the electrical conducting contact of the first device.

It is an object of the present invention to minimize the magnetic strength of the magnetic components necessary to latch a pair of devices.

It is another object of the present invention to establish and maintain alignment of the latching of a pair of devices without utilizing the perimeter of the devices.

This and other advantages of the present invention will become more apparent from the following description of the preferred embodiments.

DESCRIPTION OF THE PREFERRED EMBODIMENTS

Figure 1A:
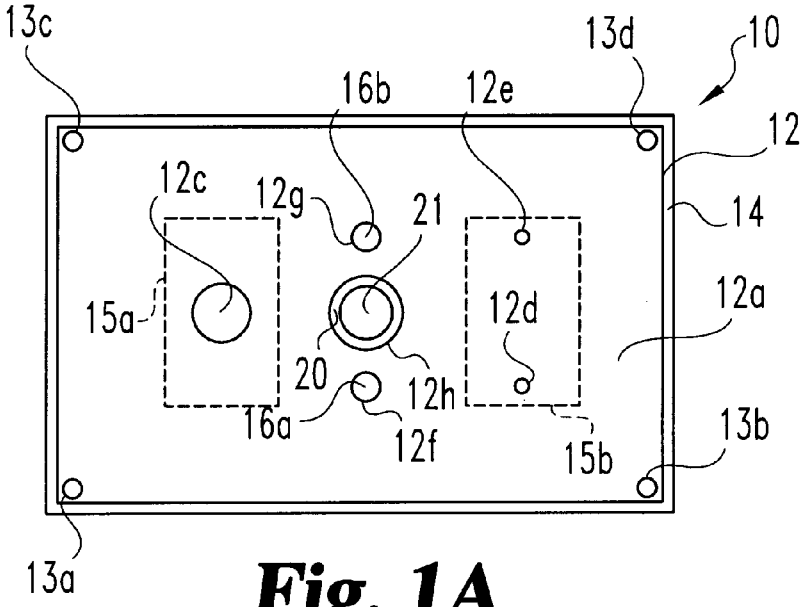
FIG. 1A is a top view of a battery pack 10 in accordance with the present invention.

For the purposes of promoting an understanding of the principles of the present invention, reference will now be made to the embodiments illustrated in the drawings and specific language will be used to describe the same. It will nevertheless be understood that no limitation of the scope of the present invention is thereby intended, such alterations and further modifications in the illustrated embodiments, and such further applications of the principles of the present invention as illustrated therein being contemplated as would normally occur to one skilled in the art to which the present invention relates.

Figure 1B:
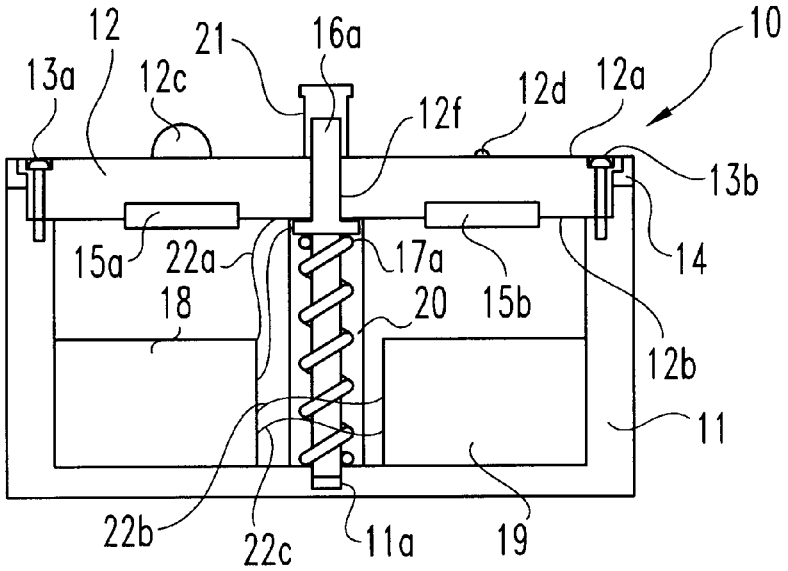
FIG. 1B is a schematic view of battery pack 10 in FIG. 1A.

Referring to FIGS. 1A and 1B, battery pack 10 comprises a container 11, a lid 12 detachably coupled to container 11 via screws 13*a*, 13*b*, 13*c* and 13*d* to constitute a case for housing a power source, and a seal 14 disposed between the coupling of container 111 and lid 12 to prevent moisture from entering container 11. The present invention contemplates that container 11, lid 12 and seal 14 can vary in geometric shape and size, and can be made from any material that does not conduct an electric charge. The present invention also contemplates that lid 12 can alternatively be permanently coupled, e.g. integrated or affixed, to container 11 to form a case, and seal 14 can be optionally removed. Lid 12 includes a first alignment member 12*c* extending away from an outer surface 12*a* of lid 12, a second alignment member 12*d* extending away from outer surface 12*a*, and a third alignment member 12*e* extending away from outer surface 12*a*. For purposes of the present invention, an alignment member is broadly defined as any element of an article of manufacture separate from the perimeter of the article to inhibit any lateral movement of the article of manufacture when the element is mated with a counterpart element of a second article of manufacture. The present invention contemplates that alignment members 12*c*, 12*d* and/or 12*e* can alternatively be recessed into outer surface 12*a*.

The present invention also contemplates that alignment members 12*c*, 12*d*, and 12*e* can vary in geometric shape and size, and that the physical arrangement of alignment members 12*c*, 12*d* and 12*e* on/in outer surface 12*a* can vary.

Still referring to FIGS. 1A and 1B, battery pack 10 further comprises a first magnetic component 15*a* engaging, e.g. disposed within and/or coupled to, an inner surface 12*b* of lid 12 below alignment member 12*c*, and a second magnetic component 15*b* engaging inner surface 12*b* below alignment members 12*d* and 12*e*. For purposes of the present invention, magnetic component is broadly defined as a magnet or any article of manufacture capable of being magnetized by a magnet. The present invention contemplates that a portion or the whole of magnetic component 15*a* can be disposed within alignment member 12*c*, and a portion of magnetic component 15*b* can be disposed within alignment members 12*d* and/or 12*e*, or the whole of magnetic component 15*b* can be disposed within either alignment member 12*d* or alignment member 12*e*. The present invention further contemplates that magnetic component 15*a* can border a periphery of alignment member 12*c* when alignment member 12*c* is recessed in outer surface 12*a*, and that magnetic component 15*b* can border a periphery of alignment members 12*d* and/or 12*e* when alignment members 12*d* and/or 12*e* are recessed into outer surface 12*a*. The present invention also contemplates that magnetic component 15*a* can alternatively be offset from below alignment member 12*c*, and that magnetic component 15*b* can alternatively be offset from below alignment members 12*d* and 12*e*.

Still referring to FIGS. 1A and 1B, battery pack 10 further comprises a first electrical conducting contact 16*a* slidably disposed within a slot 11*a* of container 11 and biased by a spring 17*a* to extend through an aperture 12*f* of lid 12, a second electrical conducting contact 16*b* slidably disposed within a slot 11*b* (not shown) of container 11 and biased by a spring 17*b* (not shown) to extend through an aperture 12*g* of lid 12, a AC/DC power converter 18 disposed within container 11 and electrically coupled to contacts 16*a* and 16*b* via a wire 22*a* and a wire 22*d*, respectively, and a battery 19 disposed within container 11 and electrically coupled to AC/DC power converter 18 via a wire 22*b* and a wire 22*c* to constitute a power source. The present invention contemplates that when magnetic components 15*a* and 15*b* are offset from alignment members 12*c*, 12*d*, and 12*e*, respectively, contact 16*a* can alternatively extend through an aperture disposed in alignment member 12*c*, and contact 16*b* can alternatively extend through an aperture disposed in either alignment member 12*d*, alignment member 12*e*, or an alternative/additional alignment member. It is to be appreciated and understood that any circuit in electrical communication with contacts 16*a* and 16*b* will receive power from AC/DC power converter 18 as driven by battery 19. It is to be further appreciated and understood that battery 19 can be replaced as needed. Battery pack 10 further comprises a support member 20 disposed within and coupled to container 11, and a stand member 21 slidably disposed within support member 20 and extendable through an aperture 12*h* of lid 12 beyond contacts 16*a* and 16*b* as shown in FIG. 1B. It is to be appreciated and understood that stand member 21 can be fully extended from support member 20 to prevent contacts 16*a* and 16*b* from contacting conductive material, and can be fully retracted into support member 20 to enable contacts 16 and 16*b* to be electrically coupled to a circuit.

Figure 2A:
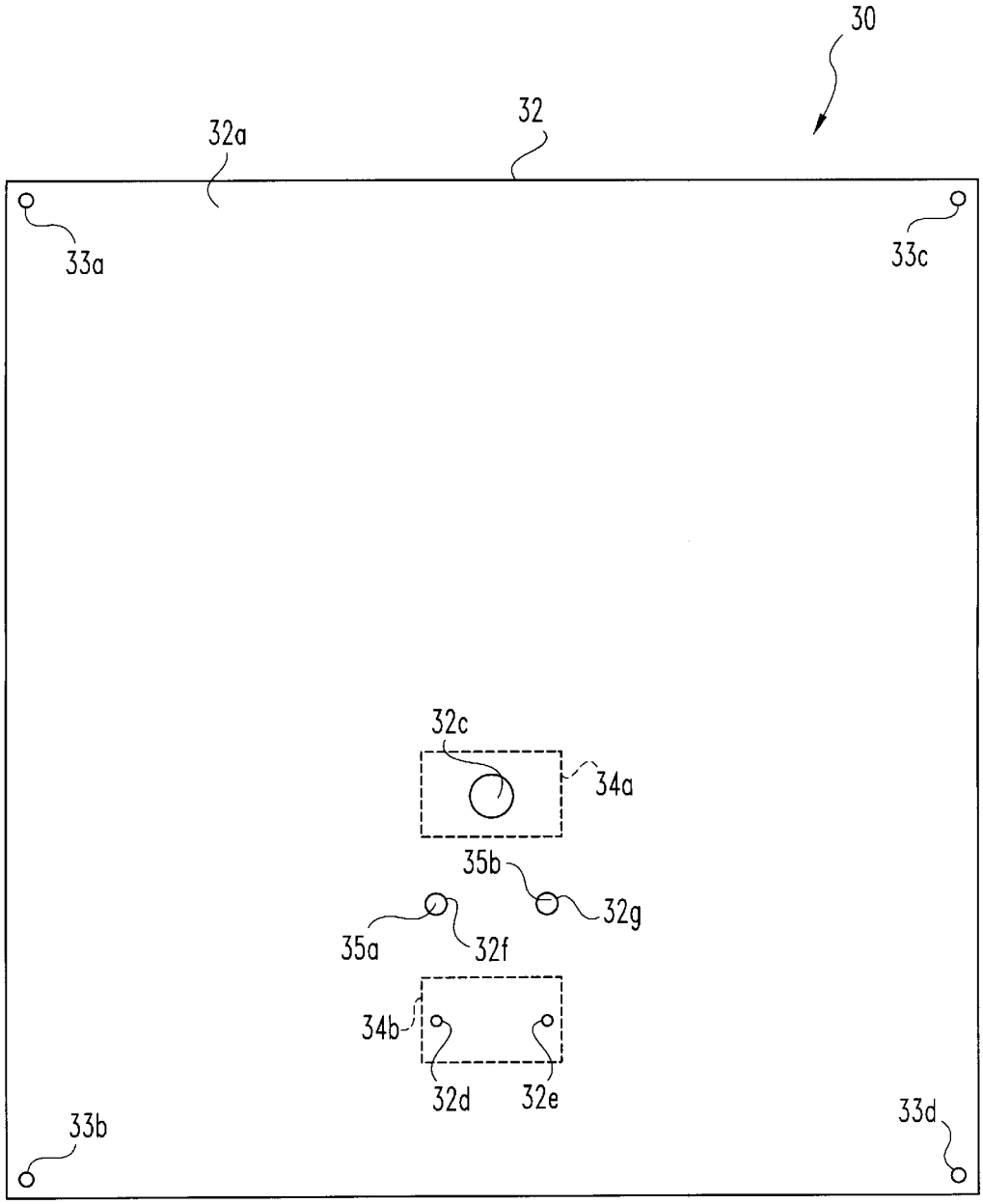
FIG. 2A is a rear view of a portable device 30 in accordance with the present invention.
Figure 2B:
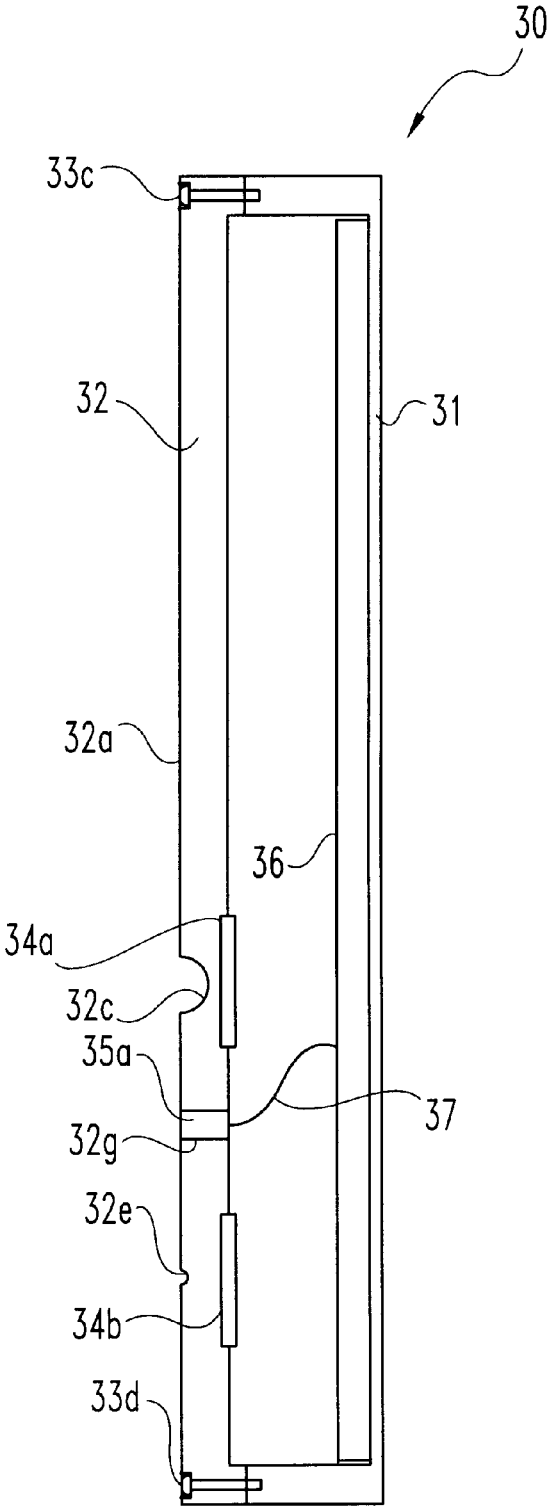
FIG. 2B is a schematic view of portable device 30 in FIG. 2A.

Referring to FIGS. 2A and 2B, portable device 30 comprises a container 31, and a lid 32 detachably coupled to container 31 via screws 33*a*, 33*b*, 33*c* and 33*d* to constitute a case for housing a circuit. The present invention contemplates that container 31 and lid 32 can vary in geometric shape and size, and can be made from any material that does not conduct an electric charge. The present invention also contemplates that lid 32 can alternatively be permanently coupled, e.g. integrated or affixed, with container 31 to form a case. Lid 32 has a first alignment member 32*c* recessed within an outer surface 32*a* of lid 32 and configured to mate with alignment member 12*c* of lid 12, a second alignment member 32*d* recessed within outer surface 32*a* and configured to mate with alignment member 12*d* of lid 12, and a third alignment member 32*e* recessed within outer surface 32*a* and configured to mate with alignment member 12*e* of lid 12. The arrangement of alignment members 32*c*, 32*d* and 32*e* ensures that alignment members 32*c*, 32*d* and 32*e* can simultaneously mate with alignment members 12*c*, 12*d* and 12*e*. The present invention contemplates that alignment members 32*c*, 32*d* and/or 32*e* alternatively extend from outer surface 32*a* when corresponding alignment members 12*c*, 12*d* and/or 12*e* are recessed within outer surface 12*a*. Portable device 30 further comprises a first magnetic component 34*a* engaging an inner surface 32*b* of lid 32 below alignment member 32*c*, and a second magnetic component 34*b* engaging inner surface 32*b* below alignment members 32*d* and 32*e*. The present invention contemplates that magnetic component 34*a* can be disposed within inner surface 32*b* bordering a periphery of alignment member 32*c*, and magnetic component 34*b* can be disposed within inner surface 32*b* bordering a periphery of alignment member 32*d* and/or a periphery of alignment member 32*e*. The present invention further contemplates that magnetic component 34*a* can alternatively be offset from below alignment member 32*c*, and that magnetic component 34*b* can alternatively be offset from below alignment members 32*d* and 32*e*. The present invention also contemplates that a portion or a whole of magnetic component 34*a* can be disposed within alignment member 32*c* when alignment member 32*c* is extending from outer surface 32*a*, and that, when alignment members 32*d* and/or 32*e* are extending from outer surface 32*a*, a portion or portions of magnetic component 34*b* can be disposed within alignment members 32*d* and/or 32*e* or a whole of magnetic component 34*b* can be disposed within either alignment member 32*d* or alignment member 32*e*.

Figure 3:
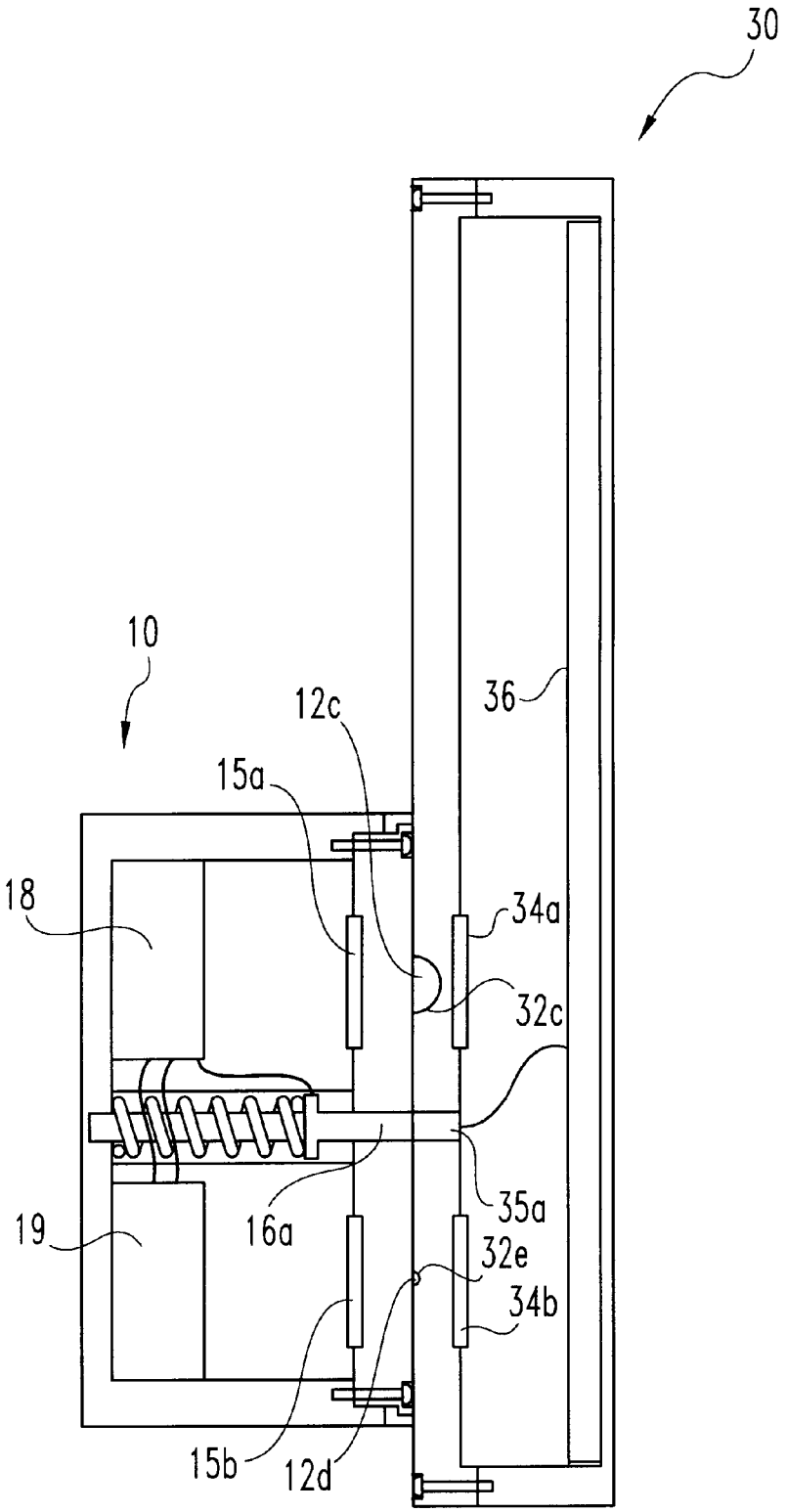
FIG. 3 is a schematic view of battery pack 10 in FIG. 1B magnetically latched to portable device 30 in FIG. 2B.

Still referring to FIGS. 2A and 2B, portable device 30 further comprises a first electrical conducting contact 35*a* disposed within an aperture 32*f* of lid 32, a second electrical conducting contract 35*b* disposed within an aperture 32*g* of lid 32, and a circuit 36 disposed within and coupled to container 31 and electrically coupled to contacts 35*a* and 35*b* via a wire 37 and a wire 38 (now shown), respectively. The present invention contemplates that contact 35*a* can alternatively be disposed within an aperture extending through alignment member 32*c* when magnetic component 34*a* is offset from alignment member 32*c*, and that contact 35*b* can alternatively be disposed within an aperture extending through either alignment member 32*d*, alignment member 32*e* or an alternative/additional alignment member when magnetic component 35*b* is offset from below alignment member 32*d*, 32*e*, or the alternative/additional alignment member. The present invention further contemplates that, when magnetic component 34*a* is offset from alignment member 32*c*, alignment member 32*c* can be made from electrical conducting material and electrically coupled to circuit 36 and contact 35*a* can be optionally removed and, when magnetic component 34*b* is offset from alignment members 32*d* and 32*e*, either alignment member 32*d*, alignment member 32*e*, or an alternative/additional alignment member can be made from electrical conducting material and electrically coupled to circuit 36 and contact 35*b* can optionally be removed. It is to be appreciated and understood, as shown in FIG. 3, that battery pack 10 can be magnetically latched to portable device 30 via magnetic components 15*a*, 15*b*, 33*a* and 33*b*, and AC/DC power converter 18 can be electrically coupled to circuit 36 via contacts 16*a*, 16*b*, 35*a*, and 35*b*. It is to be further appreciated and understood that the mating of alignment members 12*c* and 32*c*, of alignment members 12*d* and 32*d*, and of alignment members 12*e* and 32*e* when battery pack 10 is magnetically latched to portable device 30 ensures and maintains the proper alignment of contacts 16*a*, 16*b*, 35*a* and 35*b* without the utilization of the perimeter of battery pack 10 and the perimeter of portable device 30. Thus, magnetic components 15*a*, 15*b*, 34*a* and 34*b* can be made with the minimum strength necessary to latch battery pack 10 to portable device 30. Consequently, magnetic components 15*a*, 15*b*, 34*a* and 34*b* can made cheaper, and relatively small as compared to battery pack 10 and portable device 30 than otherwise.

Figure 4A:
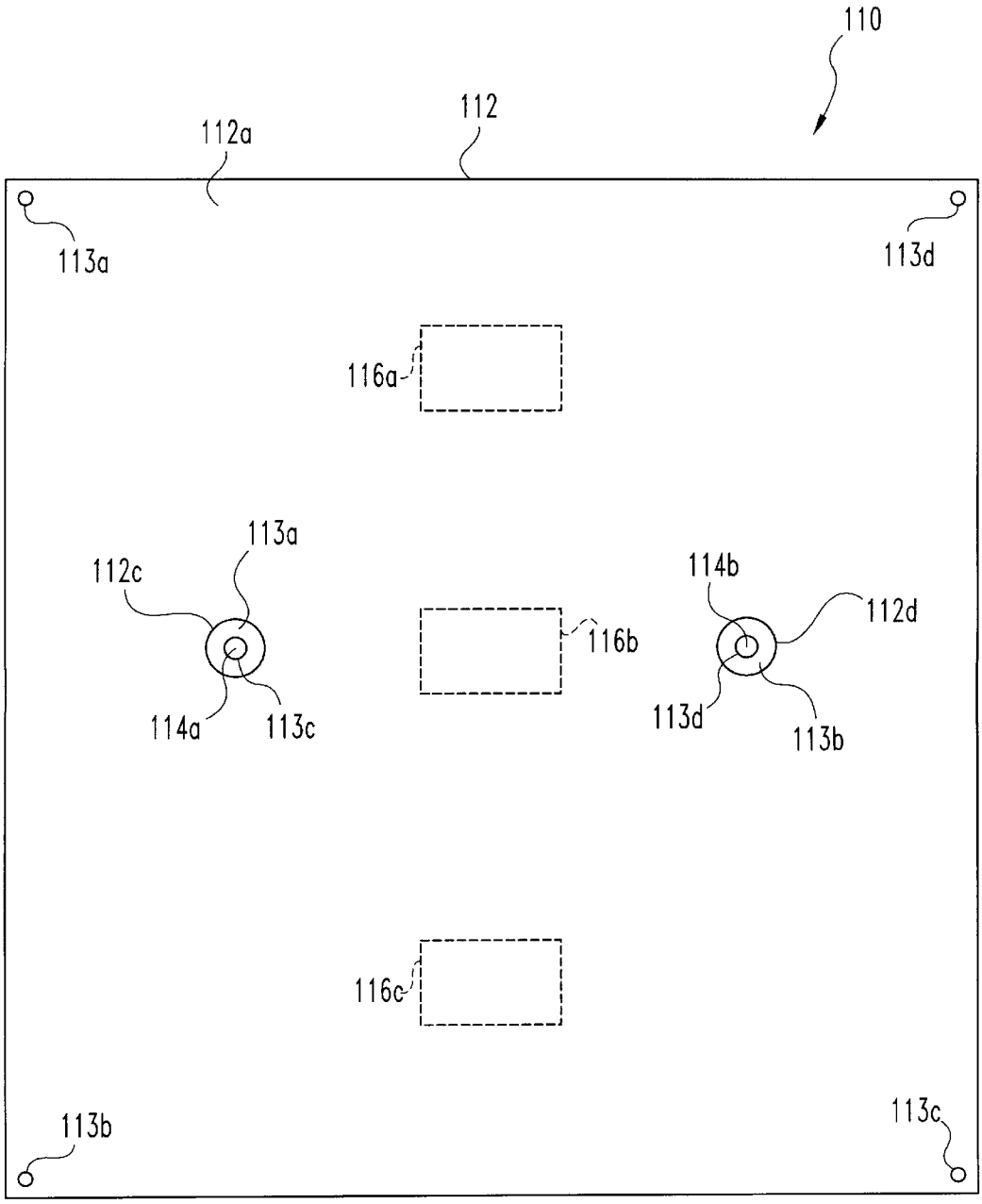
FIG. 4A is a top view of a platform 110 in accordance with the present invention.
Figure 4B:
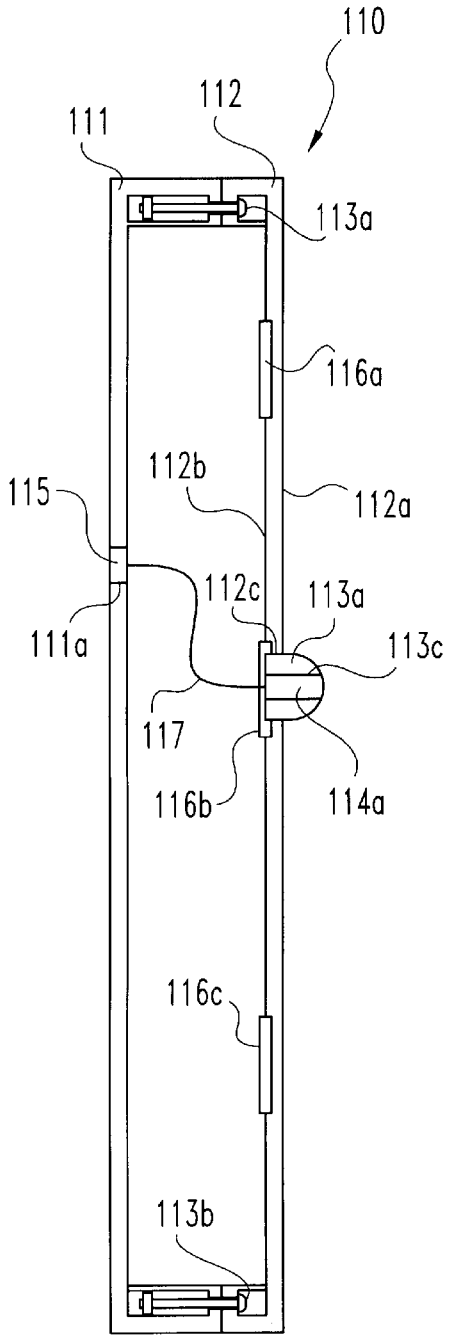
FIG. 4B is a schematic view of platform 110 in FIG. 4A.

Referring to FIGS. 4A and 4B, platform 110 comprises a container 111, and a lid 112 slidably coupled to container 111 via screws 113*a*, 113*b*, 113*c* and 113*d* to constitute a case that is adapted to be coupled to a power source. The present invention contemplates that container 111 and lid 112 can vary in geometric shape and size, and can be made from any material that does not conduct an electric charge. The present invention further contemplates that lid 112 can alternatively be detachably coupled, or permanently coupled, e.g. integrated or affixed, to container 111. Platform 110 further comprises a first alignment member 113*a* extending through an aperture 112*c* in lid 112, and a second alignment member 113*b* extending through an aperture 112*d* in lid 112. The present invention contemplates that alignment members 113*a* and 113*b* can vary in geometric shape and size, and can be made from any material that does or does not not conduct an electrical charge. The present invention further contemplates that the physical arrangement of alignment members 113*a* and 113*b* in lid 112 can vary, and that alignment members 113*a* and/or 113*b* can be recessed through apertures 112*c* and 112*d*, respectively. The present invention further contemplates that alignment members 113*a* and 113*b* can alternatively integrated with lid 112, and either extending from or recessed into an outer surface 112*a* of lid.

Still referring to FIGS. 4A and 4B, platform 110 further comprises a first electrical conducting contact 114*a* disposed within an aperture 113*c* in alignment member 113*a*, a second electrical conducting contact 114*b* disposed within an aperture 113*d* in alignment member 113*b*, and a power jack 115 extending through an aperture 111*a* in container 111 and electrically coupled to contacts 114*a* and 114*b* via a wire 117 and a wire 118 (not shown), respectively. The present invention contemplates that contacts 114*a* and 114*b* can be spring biased to extend through apertures 113*c* and 113*d*, respectively. It is to be appreciated and understood that a power source, e.g. an outlet, can be electrically coupled to power jack 115. The present invention contemplates that a power source can alternatively be disposed within platform 110 and electrically coupled to contacts 114*a* and 114*b*. Platform 110 further comprises a first magnetic component 116*a* engaging an inner surface 112*b* of lid 112, a second magnetic component 116*b* engaging inner surface 112*b*, and a third magnetic component 116*c* engaging inner surface 112*b*. The present invention contemplates that the arrangement of magnetic components 116*a*, 116*b* and 116*c* within inner surface 111*b* can vary. The present invention further contemplates that, alternatively or concurrently, alignment members 113*a* and 113*b* can be made from magnetic material.

Figure 5B:
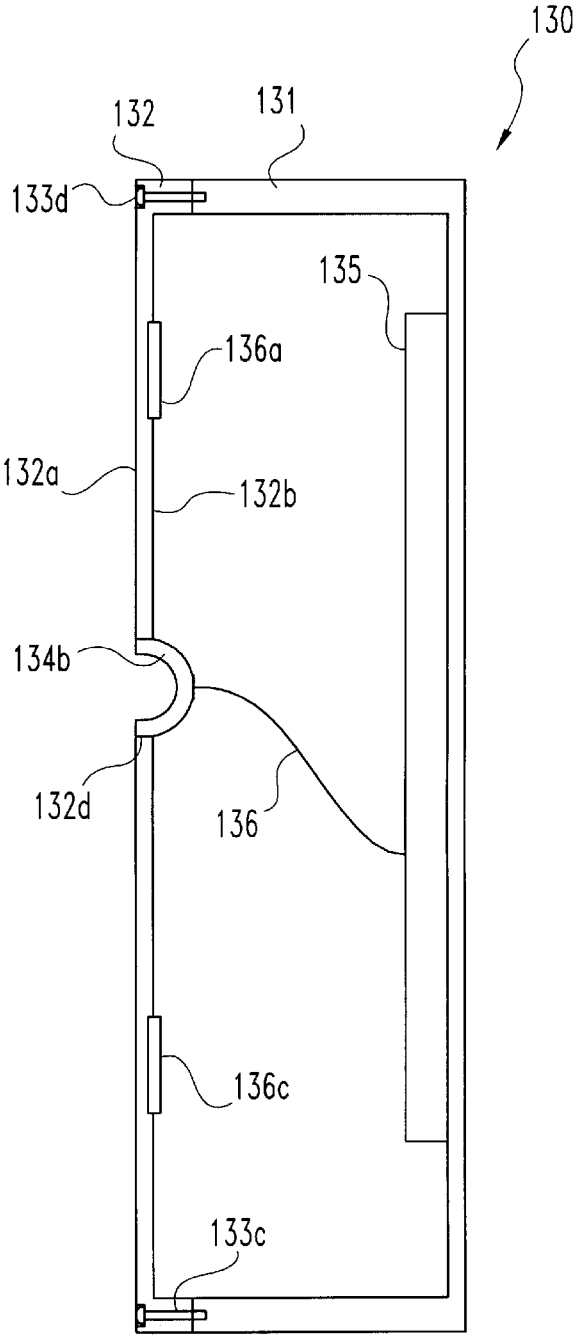
FIG. 5B is a schematic view of portable device 130 in FIG. 5A.
Figure 5A:
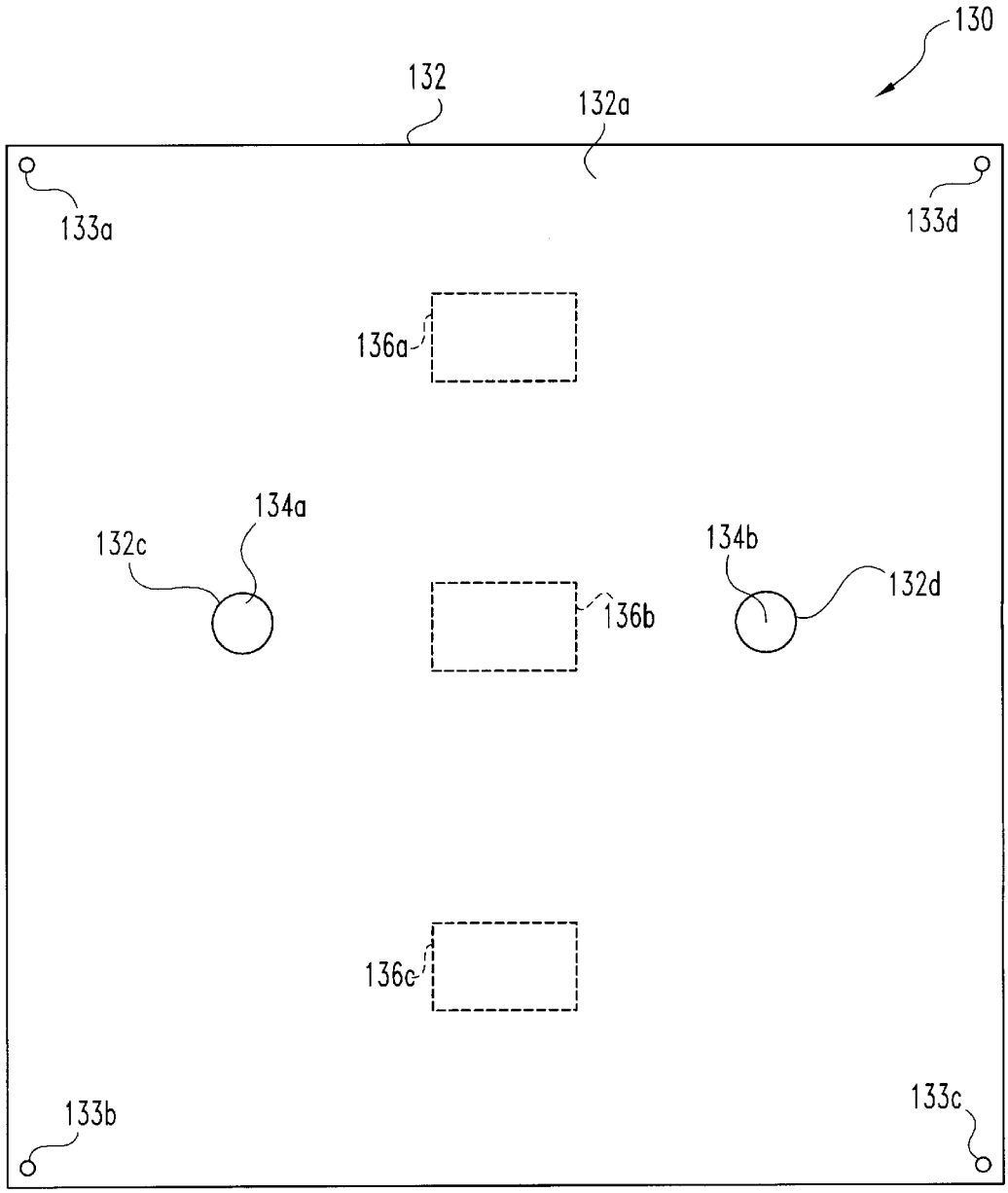
FIG. 5A is a rear view of a portable device 130 in accordance with the present invention.

Referring to FIGS. 5A and 5B, portable device 130 comprises a container 131, and a lid 132 detachably coupled to container 131 via screws 133*a*, 133*b*, 133*c* and 133*d* to constitute a case for housing a circuit. The present invention contemplates that container 131 and lid 132 can vary in geometric shape and size, and can be made from any material that does not conduct an electric charge. The present invention further contemplates that lid 132 can be permanently coupled, e.g. integrated or affixed, to container 131. Portable device 130 further comprises a first alignment member 134*a* recessing within an aperture 132*c* of lid 132 and configured to mate with alignment member 113*a*, and a second alignment member 134*b* recessing within an aperture 132*d* of lid 132 and configured to mate with alignment member 113*b*, and a circuit 135 disposed within and coupled to container 131. Alignment members 134*a* and 134*b* are made from electrical conductive material and are electrically coupled to circuit 135 via a wire 136 and a wire 137, respectively. The arrangement of alignment members 134*a* and 134*b* ensures that alignment members 134*a* and 134*b* can simultaneously mate with alignment members 113*a* and 113*b*. The present invention contemplates that alignment members 134*a* and/or 134*b* can alternatively extend through apertures 132*c* and 132*d*, respectively, when alignment members 113*a* and/or 113*b* are recessed through apertures 112*c* and 112*d*. The present invention contemplates that alignment members 134*a* and 134*b* can alternatively be made from material that does not conduct an electric charge, and integrated with an outer surface 132*a* of lid 132 and extending from or recessed within apertures 132*c* and 132*d*, respectively. Accordingly, the present invention further contemplates that electrical conducting contacts can be disposed within an aperture in alignment members 134*a* and 134*b* and electrically coupled to circuit 135, and that such contacts can be optionally spring biased to extend through the apertures in alignment members 134*a* and 134*b*.

Figure 6:
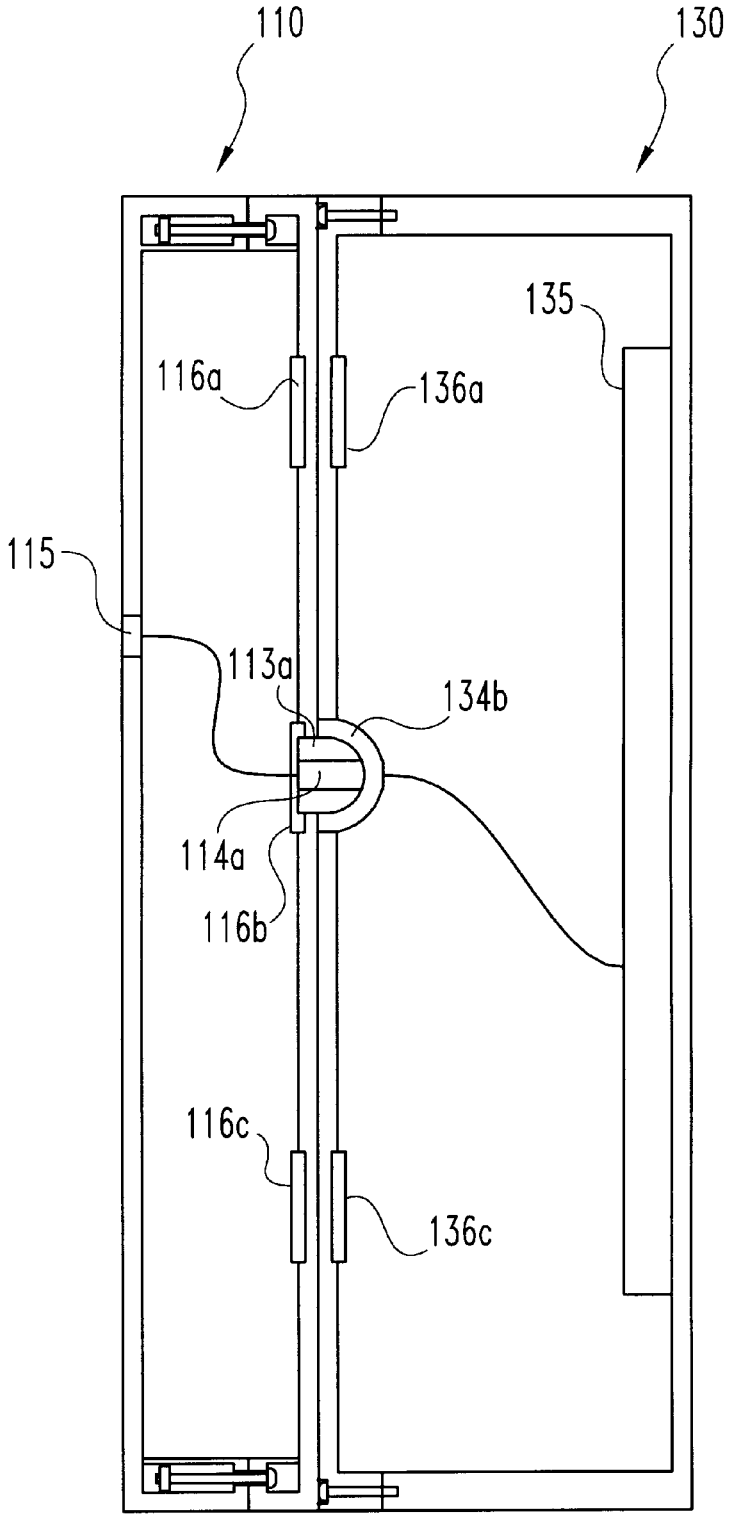
FIG. 6 is a schematic view of platform 110 in FIG. 4B magnetically latched to portable device 130 in FIG. 5B.

Still referring to FIGS. 5A and 5B, portable device 130 further comprises a first magnetic component 136*a* engaging an inner surface 132*b* of lid 132, a second magnetic component 136*b* engaging inner surface 132*b*, and a third magnetic component 136*c* engaging inner surface 132*b*. The present invention contemplates that the arrangement of magnetic components 136*a*, 136*b*, and 136*c* ensures the magnetic latching of portable device 130 to platform 110. The present invention further contemplates that, alternatively or concurrently, alignment members 134*a* and/or 134*b* can be made from magnetic material when electrical conducting contacts are disposed within or extending from apertures in alignment members 134*a* and/or 134*b*. It is to be appreciated and understood, as shown in FIG. 6, that portable device 130 can be magnetically latched to platform 110 via magnetic components 116*a*, 116*b*, 116*c*, 136*a*, 136*b* (not shown), and 136*c*, and that a power source can be electrically coupled to circuit 135 via contacts 114*a* and 114*b*, and alignment members 134*a* and 134*b* as well as power jack 115. It is to be further appreciated and understood that the mating of alignment members 113*a* and 134*a*, and of alignment members 113*b* and 134*b* when portable device 130 is magnetically latched to platform 110 ensures and maintains the proper alignment of contacts 114*a* and 114*b* within alignment members 134*a* and 134*b* without the utilization of the perimeter of platform 110 and the perimeter of portable device 130. Thus, magnetic components 116*a*, 116*b*, 116*c*, 136*a*, 136*b*, and 136*c* can be made with the minimum strength necessary to latch portable device 130 to platform 110. Consequently, magnetic components 116*a*, 116*b*, 116*c*, 136*a*, 136*b*, and 136*c* can made cheaper, and relatively small as compared to platform 110 and portable device 130 than otherwise.

While the present invention has been illustrated and described in detail in the drawings and foregoing description, the same is to be considered as illustrative and not restrictive in character, it being understood that the preferred embodiments have been shown and described and that all changes and modifications that come within the spirit of the invention are desired to be protected.

What is claimed is:

1. A device for electrically coupling a power source to a circuit, the circuit being housed in a portable device, said device comprising:

a case having an outer surface;

a magnetic component engaging said case to magnetically latch said case to the portable device;

an alignment member separate from a perimeter of said case to mate with the portable device when said case is magnetically latched to the portable device; and an electrical conducting contact disposed within a first aperture of said case and adapted to electrically couple the power source to the circuit when said case is magnetically latched to the portable device;

wherein said electrical conducting contact is disposed within an aperture of said alignment member.

2. The device of claim 1 wherein said alignment member is integrated with said outer surface of said case and extends from said outer surface.

3. The device of claim 1 wherein said alignment member is disposed in a second aperture of said case and extends from said second aperture.

4. The device of claim 1 wherein said alignment member is integrated with said first aperture of said case and extends from said first aperture.

5. The device of claim 1 wherein said alignment member is disposed within said first aperture of said case and extends from said first aperture.

6. The device of claim 1 wherein said alignment member is integrated with said outer surface of said case and is recessed within said outer surface.

7. The device of claim 1 wherein said alignment member is disposed within a second aperture of said case and is recessed within said second aperture.

8. The device of claim 1 wherein said alignment member is integrated with said first aperture of said case and is recessed within said first aperture.

9. The device of claim 1 wherein said alignment member is disposed within said first aperture of said case and is recessed within said first aperture.

10. The device of claim 1 wherein said case includes a container, and a lid coupled to said container.

11. The device of claim 1 wherein the power source is disposed within said case and electrically coupled to said first electrical conducting contact.

12. The device of claim 1 wherein said case includes a power jack disposed within a second aperture of said case, electrically coupled to said first electrical conducting contact and adapted to be electrically coupled to the power source.

13. A system for electrically coupling a power source to a circuit, said system comprising:

a first device including a first case having an outer surface, a first magnetic component engaging said first case, a first alignment member separate from a perimeter of said first case, and a first electrical conducting contact disposed within a first aperture of said first case and electrically coupled to the circuit; and a second device including a second case having an outer surface, a second component engaging said second case and magnetically engaged with said first magnetic component to magnetically latch said second case to said first case, a second alignment member separate from a perimeter of said second case and mated with said first alignment member, and a second electrical conducting contact disposed within a first aperture of said second case and electrically coupling the power source to the first electrical conducting contact, whereby the power source is electrically coupled to the circuit;

wherein said electrical conducting contact is disposed within an aperture of said alingment member.

14. The system of claim 13 wherein said first alignment member is integrated with said outer surface of said first case and extends from said outer surface of said first case.

15. The system of claim 13 wherein said first alignment member is disposed within a second aperture of said first case and extends from said second aperture of said first case.

16. The system of claim 13 wherein said first alignment member is integrated with said first aperture of said first case and extends from said first aperture of said first case.

17. The system of claim 13 wherein said first alignment member is disposed within said first aperture of said first case and extends from said first aperture of said first case.

18. The system of claim 13 wherein said first alignment member is integrated with said outer surface of said first case and is recessed within said outer surface of said first case.

19. The system of claim 13 wherein said first alignment member is disposed within a second aperture of said first case and is recessed within said second aperture of said first case.

20. The system of claim 13 wherein said first alignment member is integrated with said first aperture of said first case and is recessed within said first aperture of said first case.

21. The system of claim 13 wherein said first alignment member is disposed within said first aperture of said first case and is recessed within said first aperture of said first case.

22. The system of claim 13 wherein said second alignment member is integrated with said outer surface of said second case and extends from said outer surface of said second case.

23. The system of claim 13 wherein said second alignment member is disposed within a second aperture of said second case and extends from said second aperture of said second case.

24. The system of claim 13 wherein said second alignment member is integrated with said first aperture of said second case and extends from said first aperture of said second case, and said second electrical conducting contact is disposed within an aperture of said second alignment member.

25. The system of claim 13 wherein said second alignment member is disposed within said first aperture of said second case and extends from said first aperture of said second case, and wherein said second electrical conducting contact is disposed within an aperture of said second alignment member.

26. The system of claim 13 wherein said second alignment member is integrated with said outer surface of said second case and is recessed within said outer surface of said second case.

27. The system of claim 13 wherein said second alignment member is disposed within a second aperture of said second case and is recessed within said second aperture of said second case.

28. The system of claim 13 wherein said second alignment member is integrated with said first aperture of said second case and is recessed within said first aperture of said second case, and wherein said second electrical conducting contact is disposed within an aperture of said second alignment member.

29. The system of claim 13 wherein said second alignment member is disposed within said first aperture of said second case and is recessed within said first aperture of said second case, and wherein said second electrical conducting contact is disposed within an aperture of said second alignment member.

30. The system of claim 13 wherein said second case includes a container, and a lid coupled to said container.

31. The system of claim 13 wherein the power source is disposed within said second case and electrically coupled to said second electrical conducting contact.

32. The system of claim 13 wherein said second case includes a power jack disposed in a second aperture of said case, and electrically coupled to said second electrical conducting contact and to the power source.

* * * * *